US011078653B2

(12) United States Patent
Huang et al.

(10) Patent No.: US 11,078,653 B2
(45) Date of Patent: Aug. 3, 2021

(54) JET REGULATOR FOR SWITCHING WATER SPRAY PATTERNS

(71) Applicant: Xiamen Solex High-Tech Industries Co., Ltd., Xiamen (CN)

(72) Inventors: Feilong Huang, Xiamen (CN); Guosong Zhao, Xiamen (CN); Wenxing Chen, Xiamen (CN)

(73) Assignee: Xiamen Solex High-Tech Industries Co., Ltd., Xiamen (CN)

( * ) Notice: Subject to any disclaimer, the term of this patent is extended or adjusted under 35 U.S.C. 154(b) by 179 days.

(21) Appl. No.: 16/550,551

(22) Filed: Aug. 26, 2019

(65) Prior Publication Data

US 2019/0376265 A1 Dec. 12, 2019

Related U.S. Application Data

(63) Continuation of application No. PCT/CN2017/115888, filed on Dec. 13, 2017.

(30) Foreign Application Priority Data

Feb. 24, 2017 (CN) ..... 201710103049.3

(51) Int. Cl.
*E03C 1/084* (2006.01)
*B05B 1/16* (2006.01)
*B05B 1/30* (2006.01)

(52) U.S. Cl.
CPC ..... *E03C 1/084* (2013.01); *B05B 1/169* (2013.01); *B05B 1/30* (2013.01)

(58) Field of Classification Search
CPC ..... E03C 1/084; B05B 1/169; B05B 1/30
(Continued)

(56) References Cited

U.S. PATENT DOCUMENTS 5,348,231 A * 9/1994 Arnold ..... E03C 1/084 239/428.5
7,552,879 B2 * 6/2009 Nagata ..... E03C 1/08 239/428.5

(Continued)

FOREIGN PATENT DOCUMENTS

CN 1722039 A 1/2006
CN 200975548 Y 11/2007

(Continued)

OTHER PUBLICATIONS

International Search Report and Written Opinion with English Translation of ISR, cited in PCT/CN2017/115888 dated Mar. 7, 2018, 13 pages.

*Primary Examiner* — Christopher S Kim
(74) *Attorney, Agent, or Firm* — Cooper Legal Group, LLC

(57) ABSTRACT

The present invention provides a jet regulator for switching water spray patterns, comprising: a body, a divider coaxially disposed at a first end of the body, and a water outlet cover coaxially disposed at a second end of the body. The divider is circumferentially disposed with a plurality of water dividing hole sets. An axial center of the body is provided with a connecting member connected to the divider. An outer wall of the connecting member and an inner wall of the body are radially connected by a plurality of ribs. The plurality of ribs, the outer wall of the connecting member, and the inner wall of the body jointly define a plurality of chambers which are circumferentially disposed. When the body is subjected to a rotational force along a circumferential direction, the body and the divider are relatively rotated.

11 Claims, 6 Drawing Sheets

(58) Field of Classification Search
USPC ..... 239/28.5, 443–449
See application file for complete search history.

(56) References Cited

U.S. PATENT DOCUMENTS

| | | | | |
|---|---|---|---|---|
| 8,402,995 | B2 * | 3/2013 | Zoller | G05D 7/012 137/454.2 |
| 8,757,518 | B2 * | 6/2014 | Kao | E03C 1/08 239/582.1 |
| 9,068,329 | B2 * | 6/2015 | Gransow | E03C 1/084 |
| 9,663,928 | B2 * | 5/2017 | Stein | E03C 1/08 |
| 2011/0290916 | A1 | 12/2011 | Cummings et al. | |
| 2015/0252555 | A1 * | 9/2015 | Huang | E03C 1/084 239/428.5 |
| 2016/0177553 | A1 * | 6/2016 | Bosio | E03C 1/084 239/428.5 |

FOREIGN PATENT DOCUMENTS

| | | | |
|---|---|---|---|
| CN | 102366733 | A | 3/2012 |
| CN | 104138813 | A | 11/2014 |
| CN | 204769276 | U | 11/2015 |
| CN | 204781152 | U | 11/2015 |
| CN | 205712344 | U | 11/2016 |
| CN | 206599820 | U | 10/2017 |
| JP | 3816332 | B2 | 8/2006 |

* cited by examiner

JET REGULATOR FOR SWITCHING WATER SPRAY PATTERNS

RELATED APPLICATIONS

This application is a continuation of and claims priority to PCT Patent Application PCT/CN2017/115888, filed on Dec. 13, 2017, which claims priority to Chinese Patent Application 201710103049.3, filed on Feb. 24, 2017. PCT Patent Application PCT/CN2017/115888 and Chinese Patent Application 201710103049.3 are incorporated herein by reference.

FIELD OF THE INVENTION

The present invention relates to a water outlet device, and more particularly relates to a jet regulator.

BACKGROUND OF THE INVENTION

A jet regulator is installed at the water outlet end of a water outlet device, so that the water is dispersed and mixed with air to form aerated water. With an addition of the air, the aerated water becomes softer, and an impact force of the aerated water is weakened. Therefore, an amount of water usage is effectively reduced, and water is saved. Further, the aerated water is not easy to splash around and has been widely used in homes today. However, when users want to use water flow with a strong impact force, it is difficult to meet requirements of the users with aerated water. Traditional shower water can be used to solve this problem. However, when a faucet is installed with an aerator, it only has a water spray pattern of aerated water. The water spray patterns of the aerator cannot be freely selected and is limited in use. Therefore, it is necessary to add a new spray pattern of shower water to the aerator so that the users can freely select the aerated water or the shower water according to their requirements, therefore meeting needs of different applications.

SUMMARY OF THE INVENTION

The present invention provides a jet regulator with water spray patterns of shower water and aerated water, the water spray patterns can be freely switched.

In order to solve the aforementioned technical problems, the present invention provides a jet regulator for switching water spray patterns, comprising: a body, a divider coaxially disposed at a first end of the body, and a water outlet cover coaxially disposed at a second end of the body.

A first side of the divider facing a water inflow end is disposed with a convex portion at a center of a circle, and a plurality of water dividing hole sets are circumferentially disposed between an outer circumference of the convex portion and an inner circumference of the divider at intervals. Each of the plurality of water dividing hole sets comprises a plurality of water dividing holes in a radial direction. The outer circumference of the convex portion is an annular guiding inclined surface. Water reaches the convex portion and is guided to flow to the plurality of water dividing hole sets by the guiding inclined surface.

The water outlet cover is provided with a plurality of first water outlet holes and a plurality of second water outlet holes. The plurality of first water outlet holes are uniformly disposed on an outer circumference of the plurality of second water outlet holes.

An axial center of the body is provided with a connecting member connected to the divider. An outer wall of the connecting member and an inner wall of the body are radially connected by a plurality of ribs. The plurality of ribs, the outer wall of the connecting member, and the inner wall of the body jointly define a plurality of chambers which are circumferentially disposed. One of two adjacent chambers of the plurality of chambers is a first water outlet chamber, and the other one of the plurality of chambers is a second water outlet chamber.

A water outlet of the first water outlet chamber is disposed at a bottom of the first water outlet chamber which is close to the inner wall of the body. The bottom of the first water outlet chamber corresponding to the plurality of water dividing hole sets is provided with a first guiding surface. The first guiding surface inclines downwardly in a direction from the outer wall of the connecting member to the inner wall of the body, and a lower end of the first guiding surface is connected to the water outlet of the first water outlet chamber. The water flows out from the plurality of water dividing hole sets, and then flows into the water outlet of the first water outlet chamber through the first guiding surface. The water outlet of the first water outlet chamber is disposed with a grid rectifier.

A water outlet of the second water outlet chamber is disposed at a side wall of the second water outlet chamber corresponding to the outer wall of the connecting member, and a bottom portion of the second water outlet chamber is disposed with a second guiding surface. The second guiding surface inclines downwardly in a direction from the inner wall of the body to the outer wall of the connecting member, and a lower end of the second guiding surface is connected to the water outlet of the second water outlet chamber. The water flows out from the plurality of water dividing hole sets, and then flows into the water outlet of the second water outlet chamber through the second guiding surface.

An enlarged port is disposed at a position of the body below the water outlet of the second water outlet chamber. The enlarged port has a gradually enlarged opening from one end adjacent to the second water outlet chamber to the other end.

When the divider is connected to the connecting member, a gap is formed between a water outflow end of the plurality of water dividing hole sets and an upper surface of the plurality of ribs, and the first water outlet chamber and the second water outlet chamber are communicated by the gap.

When the body is subjected to a rotational force along a circumferential direction, the body and the divider are relatively rotated so that all of the plurality of water dividing hole sets are located above the first water outlet chamber or the second water outlet chamber. When the plurality of water dividing hole sets are located above the first water outlet chamber, the water flows through the plurality of water dividing holes, flows through the first water outlet chamber, and then flows out from the plurality of first water outlet holes. When the plurality of water dividing hole sets are located above the second water outlet chamber, the water flows through the plurality of water dividing hole sets, flows through the second water outlet chamber, and then flows out from the plurality of second water outlet holes, external air from the plurality of first water outlet holes enters into the first water outlet chamber through the water outlet of the first water outlet chamber, then enters into the water in the second water outlet chamber through the gap, and then flows out from the water outlet of the second water outlet chamber with the water in the second water outlet chamber. The water and the external air is mixed by a water-air mixing member to form the aerated water, and then the aerated water flows out from the plurality of second water outlet holes.

In another preferred embodiment, the upper surface of the plurality of ribs is downwardly concaved in an arc shape in an axial direction.

In another preferred embodiment, the connecting member is a socket hole. An inner side wall of the socket hole is circumferentially provided with a plurality of protruding strips at intervals, and a groove is formed between two adjacent protruding strips of the plurality of protruding strips. When the body is rotated relative to the divider so that one next groove or one next protruding strip is engaged with the divider along a rotation direction, the plurality of water dividing hole sets is correspondingly switched to a position located above the first water outlet chamber or the second water outlet chamber.

In another preferred embodiment, a water dividing piece and a metal grid are coaxially disposed to form the water-air mixing chamber. The water dividing piece is provided with a plurality of water dividing holes, and the metal grid is provided with a plurality of meshes. A hole size of the plurality of meshes is smaller than a hole size of the water dividing holes.

In another preferred embodiment, at a boundary between the plurality of first water outlet holes and the plurality of second water outlet holes, a side of the water outlet cover facing the body extends in a direction close to the body to form a first annular enclosure, and the water dividing piece and the metal grid are placed in an area surrounded by the first annular enclosure.

In another preferred embodiment, the body extends in a radial direction to form a second annular enclosure at a lower end of the water outlet of the first water outlet chamber. An annular lock groove is disposed between an inner wall of the second annular enclosure and an outer wall of the enlarged port. When the water outlet cover is mounted with the body, the first annular enclosure is embedded in the annular lock groove.

In another preferred embodiment, a side of the divider away from the body is disposed with an accommodating chamber. The convex portion and the plurality of water dividing hole sets are disposed at a bottom of the accommodating chamber, and a flow restrictor and the divider are coaxially disposed in the accommodating chamber. A front end of the flow restrictor is outwardly disposed with a position limiting block along an axial direction. The position limiting block abuts against the convex portion, ensuring a certain distance between the flow restrictor and the plurality of water dividing hole sets.

In another preferred embodiment, the grid rectifier comprises a first rib, which is circumferentially disposed, and three second ribs perpendicular to the first rib. The first rib and the second ribs jointly divide the water outlet of the first water outlet chamber into small water outlets, and the small water outlets are disposed in an array of 4×2.

In another preferred embodiment, the jet regulator further comprises an outer shell. The outer shell is coated on the body by an interference fit. When the outer shell is subjected to a rotational force in a circumferential direction, the outer shell and the body are rotated in a linked manner.

Compared with the existing techniques, the technical solution of the present invention has the following beneficial effects:

1. The present invention provides a jet regulator having two water spray patterns, which is shower water pattern and aerated water pattern. When the aerated water is selected, the water flow is in a jet pattern, a siphon effect is generated, and external air is sucked in and mixed with the water to form aerated water. When the shower water pattern is selected, the water outlet of the first water outlet chamber is disposed with a grid rectifier, which can eliminate an additional rectifier, and the outflow water is uniform and stable. The two water spray patterns can be switched only by rotating the body, there is a very obvious feeling of gear positions during the rotation process, and there is a definite indication once the user switches the water spray patterns. An operation of the switching has no direction, the user can switch the body by clockwise or counterclockwise rotation, and an experience of the user is better.

2. The present invention provides a jet regulator that, with the first annular enclosure and the second annular enclosure, the shower water and the aerated water is separated by the first annular enclosure and the second annular enclosure at a water outlet end, so that two functions will not affect each other and an application is relatively stable.

3. The present invention provides a jet regulator that includes the upper surface of the plurality of ribs between the first water outlet chamber and the second water outlet chamber downwardly concaved in an arc shape in an axial direction, thereby forming the gap. On one hand, the gap allows air to flow from the first water outlet chamber into the second water outlet chamber. On the other hand, the gap is disposed away from the two water outlets, so that the water in one of the two water outlet chambers will not be easily flow into the remaining water outlet chamber through the gap, so as to further ensure that there is no interference between the two water spray patterns.

4. The present invention provides a jet regulator that causes the water to flow into the divider and impact on the convex portion, and then the water is guided by the guiding inclined surface to flow to the plurality of water dividing holes disposed at the outer circumference of the convex portion. Therefore, the flow rate is greatly reduced, and the flow volume is restricted by the plurality of water dividing holes. Accordingly, the flow rate and the flow volume can be both reduced. In addition, the first water outlet chamber and the second water outlet chamber are respectively disposed with a first guiding surface and a second guiding surface, the water flowing out from the plurality of water dividing holes is guided and then enters the water outlet, which is used to avoid water spray failure due to water directly flowing from the plurality of water dividing holes to the water outlet. At the same time, the second guiding surface can be used to gather aerated water together, so that the aerated water is more round and full 5. The present invention provides a jet regulator that, as the water outlet of the second water outlet chamber is disposed on the outer wall of the connecting member, a diameter of the water outflow flowing out from the water outlet of the second water outlet chamber is relatively small, and the water outflow is too thin. In order to solve this problem, an enlarged port is disposed at a position of the body below the water outlet of the second water outlet chamber, so as to increase the diameter of the aerated water flowing through.

DETAILED DESCRIPTION OF THE EMBODIMENTS

The present invention will be further described below with the combination of the accompanying drawings together with the embodiments.

Figure 1:
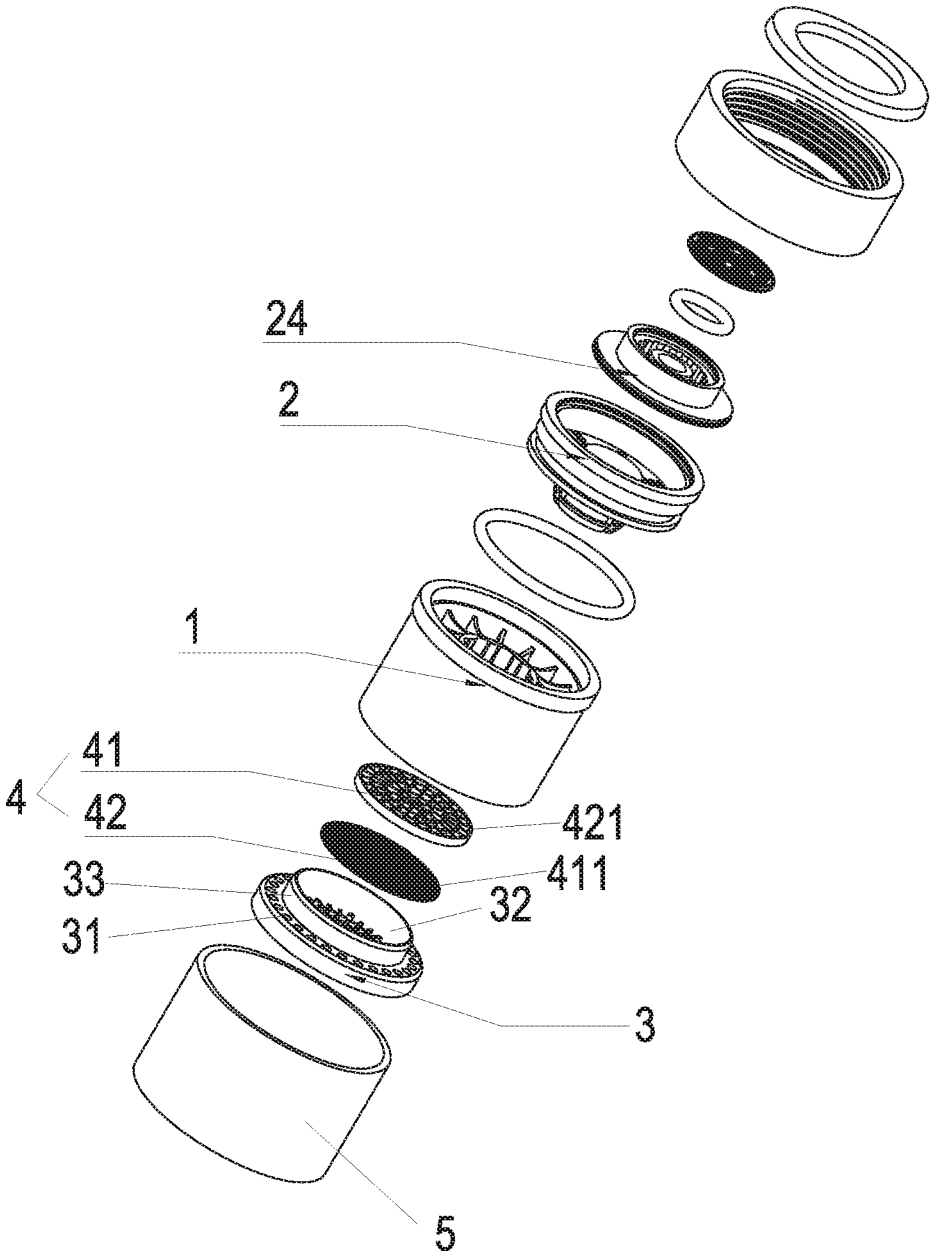
FIG. 1 illustrates an exploded perspective view of a preferred embodiment of the present invention.
Figure 2:
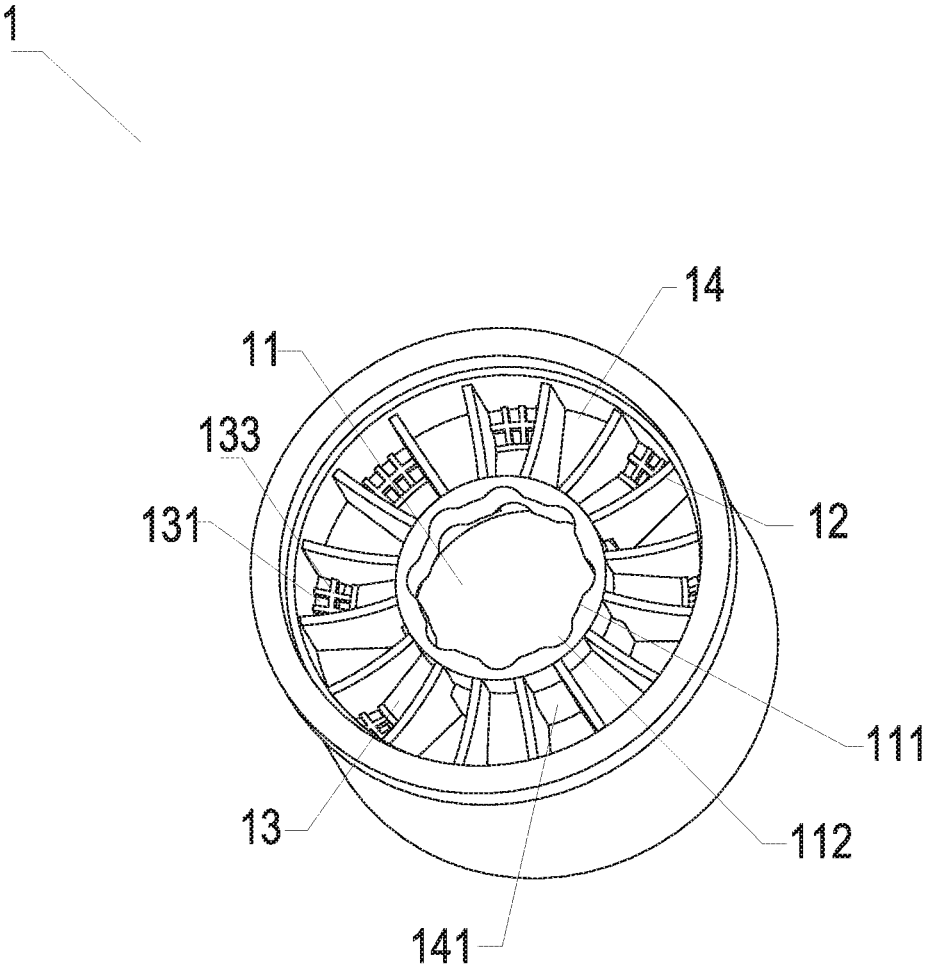
FIG. 2 illustrates a schematic view of the body in the preferred embodiment of the present invention.
Figure 3:
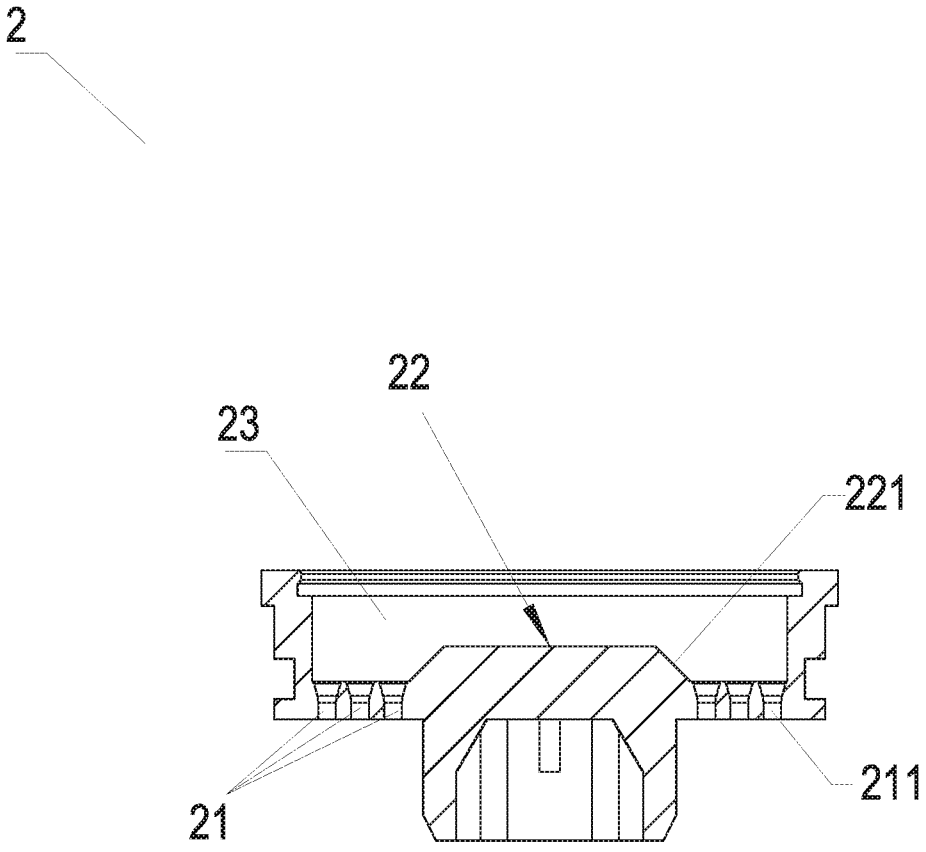
FIG. 3 illustrates a cross-sectional view of the divider in the preferred embodiment of the present invention.
Figure 4:
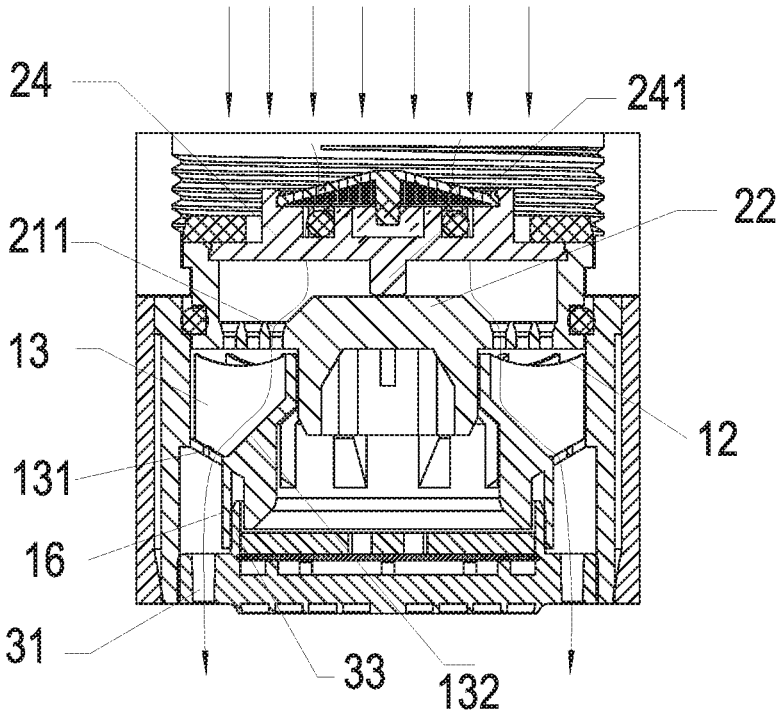
FIG. 4 illustrates the water flow passage of the preferred embodiment of the present invention when in shower water pattern.
Figure 5:
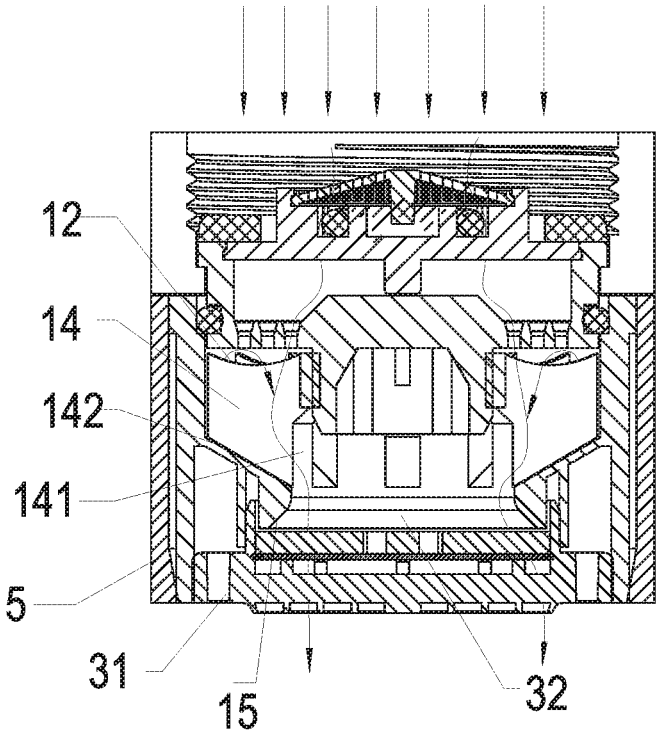
FIG. 5 illustrates the water flow passage of the preferred embodiment of the present invention when in aerated water pattern.
Figure 6:
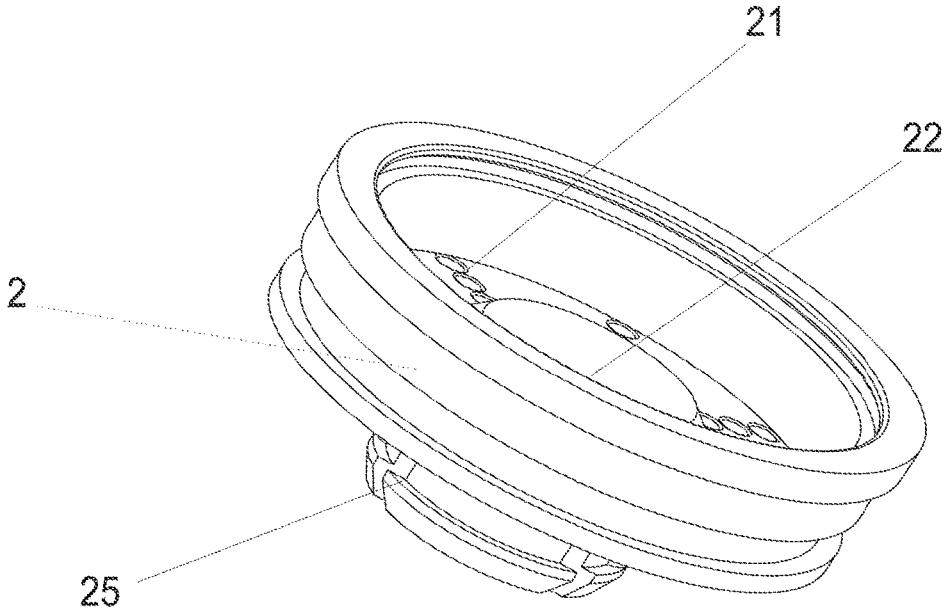
FIG. 6 illustrates a schematic view of the divider in the preferred embodiment of the present invention.
Figure 7:
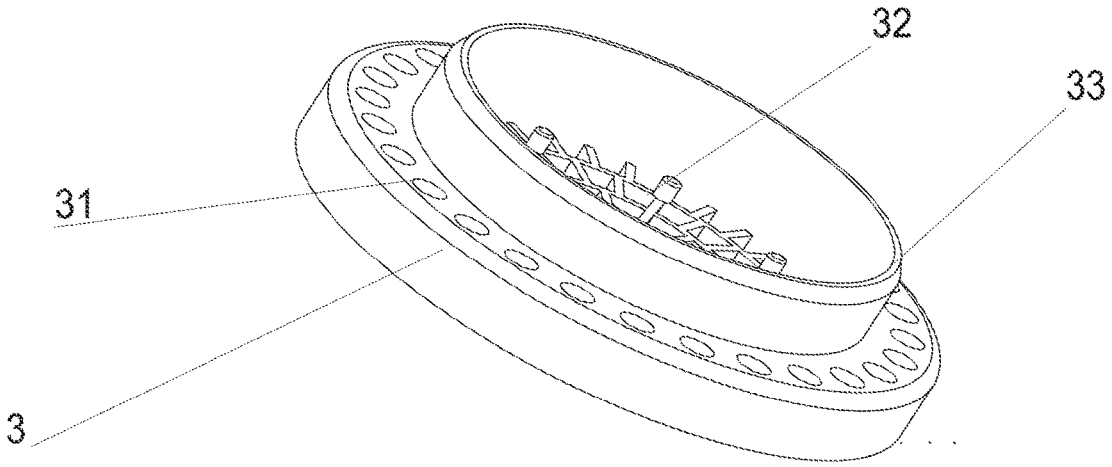
FIG. 7 illustrates a schematic view of a water outlet cover of the preferred embodiment of the present invention.

Referring to FIGS. 1-7, a jet regulator for switching water spray patterns comprises: a body 1, a divider 2 coaxially disposed at a first end of the body 1 and a water outlet cover 3 coaxially disposed at a second end of the body 1.

A first side of the divider 2 facing a water inflow end is disposed with a convex portion 22 at a center of a circle, and a plurality of water dividing hole sets 21 are circumferentially disposed between an outer circumference of the convex portion 22 and an inner circumference of the divider 2 at intervals. Each of the plurality of water dividing hole sets 21 comprises a plurality of water dividing holes 211 in a radial direction. The outer circumference of the convex portion 22 is an annular guiding inclined surface 221. Water reaches the convex portion 22 and is guided to flow into the plurality of water dividing hole sets 21 by the guiding inclined surface 221. The water flows into the divider 2 and impacts on the convex portion 22, and then the water is guided by the guiding inclined surface 221 disposed at the outer circumference of the convex portion 22 to flow to the plurality of water dividing holes 21. Therefore, the flow rate is greatly reduced, and the flow volume is restricted by the plurality of water dividing holes 211. Thus, the flow rate and the flow volume can be both reduced.

The water outlet cover 3 is provided with a plurality of first water outlet holes 31 and a plurality of second water outlet holes 32. The plurality of first water outlet holes 31 are uniformly disposed on the outer circumference of the plurality of second water outlet holes 32.

An axial center of the body 1 is provided with a connecting member 11 connected to the divider 2. The outer wall of the connecting member 11 and the inner wall of the body 1 are radially connected by a plurality of ribs 12. The plurality of ribs 12, the outer wall of the connecting member 11, and the inner wall of the body 1 jointly define a plurality of chambers which are circumferentially disposed. One of two adjacent chambers of the plurality of chambers is a first water outlet chamber 13, the other one of two adjacent chambers is a second water outlet chamber 14.

A water outlet 131 of the first water outlet chamber 13 is disposed at a bottom of the first water outlet chamber 13, and a water outlet 141 of the second water outlet chamber 14 is disposed at a side wall of the second water outlet chamber 14 corresponding to the outer wall of the connecting member 11. This arrangement ensures that the water outlet 131 of the first water outlet chamber 13 is as far as possible away from the water outlet 141 of the second water outlet chamber 14, and water flow respectively from the two water outlets will not be easily affected by each other.

In this embodiment, the bottom of the first water outlet chamber 13 corresponding to the plurality of water dividing hole sets 21 is provided with a first guiding surface 132. The first guiding surface 132 inclines downwardly in a direction from the outer wall of the connecting member 11 to the inner wall of the body 1, and a lower end of the first guiding surface 132 is connected to the water outlet 131 of the first water outlet chamber 13. The water flows out from the plurality of water dividing hole sets 21, and then flows into the water outlet 131 of the first water outlet chamber 13 through the first guiding surface 132. The water outlet 131 of the first water outlet chamber 13 is disposed with a grid rectifier 133. The first guiding surface 132 is used to avoid water spray failure due to water directly flowing out from the plurality of water dividing hole sets 21 and into the water outlet 131. A use of the grid rectifier 133 can eliminate an additional rectifier, thus providing a simple structure.

In this embodiment, the grid rectifier 133 comprises a first rib, which is circumferentially disposed, and three second ribs perpendicular to the first rib. The first rib and the second ribs jointly divide the water outlet 131 of the first water outlet chamber 13 into 8 small water outlets, and the 8 small water outlets are disposed in an array of 4×2. According to requirements of a user, rectifiers with other shapes can be also available and will not be carefully described herein.

The water outlet 141 of the second water outlet chamber 14 is disposed at a side wall of the second water outlet chamber 14 corresponding to the outer wall of the connecting member 11, and a bottom portion of the second water outlet chamber 14 is disposed with a second guiding surface 142. The second guiding surface 142 inclines downwardly in a direction from the inner wall of the body 1 to the outer wall of the connecting member 11, and a lower end of the second guiding surface 142 is connected to the water outlet 141 of the second water outlet chamber 14. The water flows out from the plurality of water dividing hole sets 21, and then flows into the water outlet 141 of the second water outlet chamber 14 through the second guiding surface 142. The second guiding surface 142 is used to avoid water spray failure due to water directly flowing from the plurality of water dividing hole sets 21 to the water outlet 141. At the same time, the second guiding surface 142 can be used to gather aerated water together, so that the aerated water is more round and full.

As the water outlet 141 of the second water outlet chamber 14 is disposed on the outer wall of the connecting member 11, a diameter of the water outflow flowing out from the water outlet 141 of the second water outlet chamber 14 is relatively small, and the water outflow is too thin. In order to solve this problem, an enlarged port 15 is disposed at a position of the body 1 below the water outlet 141 of the second water outlet chamber 14. The enlarged port 15 has a gradually enlarged opening from one end adjacent to the second water outlet chamber 14 to the other end, so as to increase the diameter of the aerated water flowing through.

When the divider 2 is connected to the connecting member 11, a gap is formed between a water outflow end of the plurality of water dividing hole sets 21 and an upper surface of the plurality of ribs 12. The first water outlet chamber 13 and the second water outlet chamber 14 are communicated by the gap. In this embodiment, the upper surface of the plurality of ribs 12 is downwardly concaved in an arc shape in an axial direction, thereby forming the gap. On one hand, the gap allows air to flow from the first water outlet chamber 13 into the second water outlet chamber 14. On the other hand, the gap is disposed away from the two water outlets 131 and 141, so that the water in one of the two water outlet chambers 13 and 14 will not easily flow into the remaining water outlet chamber 13 and 14 through the gap so as to further ensure that there is no interference between the two water spray patterns.

When the body 1 is subjected to a rotational force along an circumferential direction, the body 1 and the divider 2 are relatively rotated, so that all of the plurality of water dividing hole sets 21 are located above the first water outlet chamber 13 or the second water outlet chamber 14. When the plurality of water dividing hole sets 21 are located above the first water outlet chamber 13, the water flows through the plurality of water dividing holes 211, the first water outlet chamber 13, and then flows out from the plurality of first water outlet holes 31 to form shower water.

When the plurality of water dividing hole sets 21 are located above the second water outlet chamber 14, the water flows through the plurality of water dividing holes 211 to form a jet flow, then flows through the second water outlet chamber 14, and then flows out from the plurality of second water outlet holes 32. Since the water flow is in a jet pattern, the flow rate is high and a siphon effect is generated. External air from the plurality of first water outlet holes 31 enters into the first water outlet chamber 13 through the water outlet 131 of the first water outlet chamber 13, enters into the water in the second water outlet chamber 14 through the gap, and then flows out from the water outlet 141 of the second water outlet chamber 14 with the water in the second water outlet chamber 14. The water and the external air is mixed by a water-air mixing member 4 to form the aerated water, and then the aerated water flows out from the plurality of second water outlet holes 32.

In this embodiment, in order to enhance the hand feeling of switching, the connecting member 11 is preferably a socket hole. An inner side wall of the socket hole is circumferentially provided with a plurality of protruding strips 111 at intervals, and a groove 112 is formed between two adjacent protruding strips 111. When the body 1 is rotated relative to the divider 2, so that one next groove 112 or one next protruding strip 111 is engaged with a locker 25 of the divider 2 along a rotation direction, the plurality of water dividing hole sets 21 is correspondingly switched to a position located above the first water outlet chamber 13 or the second water outlet chamber 14. When the body 1 rotates, the divider 2 is engaged with one of the protruding strips 111 or one of the grooves 112, so that every switching has a very obvious feeling of gear positions, which give a definite indication as the user switches the water spray patterns. As operation of the switching has no direction, the user can switch the body 1 by clockwise or counterclockwise rotation, making the experience of the user better.

In this embodiment, the water-air mixing member 4 is coaxially disposed with a water dividing piece 41 and a metal grid 42. The water dividing piece 41 is provided with a plurality of water dividing holes 411, and the metal grid 42 is provided with a plurality of meshes 421. A hole size of the plurality of meshes 421 is smaller than a hole size of the water dividing holes 411. The metal grid 42 is disposed behind the water dividing piece 41 along a direction of the water outflow. The water firstly flows into the water diving holes 411 as a first division, and then enters the plurality of meshes 421 as a second division. Therefore, a size of a final aerated water is smaller, the water and air is more uniformly mixed.

At a boundary between the plurality of first water outlet holes 31 and the plurality of second water outlet holes 32, a side of the water outlet cover 3 facing the body 1 extends in a direction close to the body 1 to form a first annular enclosure 33. The water dividing piece 41 and the metal grid 42 are placed in an area surrounded by the first annular enclosure 33, thereby helping to secure the water dividing piece 41 and the metal grid 42.

The body 1 extends in a radial direction to form a second annular enclosure 16 at the lower end of the water outlet 131 of the first water outlet chamber 13. An annular lock groove is disposed between an inner wall of the second annular enclosure 16 and an outer wall of the enlarged port 15. When the water outlet cover 3 is mounted with the body 1, the first annular enclosure 33 is embedded in the annular lock groove. The shower water and the aerated water is separated by the first annular enclosure 33 and the second annular enclosure 16 at a water outlet end, so that two functions will not affect each other and an application is relatively stable.

In this embodiment, the plurality of first water outlet holes 31 are uniformly disposed on an annular outer circumference of the water outlet cover 3, and the plurality of second water outlet holes 32 are disposed in the first annular enclosure 33 in grid arrangement. A height of the second annular enclosure 16 is less than a height of an outer wall of the body 1, and when the water outlet cover 3 is mounted with the body 1, the water outlet cover 3 is almost located in the body 1.

A side of the divider 2 away from the body 1 is disposed with an accommodating chamber 23. The convex portion 22 and the plurality of water dividing hole sets 21 are disposed at the bottom of the accommodating chamber 23. A flow restrictor 24 and the divider 2 are coaxially disposed in the accommodating chamber 23. A front end of the flow restrictor 24 is outwardly disposed with a position limiting block 241 along an axial direction. The position limiting block 241 abuts against the convex portion 22, ensuring a certain distance between the flow restrictor 24 and the plurality of water dividing hole sets 21.

This embodiment further comprises an outer shell 5 that is coated on the body 1 by an interference fit. When the outer shell 5 is subjected to a rotational force in a circumferential direction, the outer shell 5 and the body 1 are rotated in a linked manner. The interference fit ensures that there is no relative rotation between the outer shell 5 and the body 1.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention relates to a jet regulator for switching water spray patterns. When the body is subjected to a rotational force along a circumferential direction, the body and the divider are relatively rotated, so that all of the plurality of water dividing hole sets are located above the first water outlet chamber or the second water outlet chamber, thereby the switching of the different water spray patterns is achieved. The present invention has wide application range and good industrial applicability.

What is claimed is:

1. A jet regulator for switching water spray patterns, comprising:

a body;

a divider coaxially disposed at a first end of the body; and a water outlet cover coaxially disposed at a second end of the body, wherein:

a first side of the divider facing a water inflow end is disposed with a convex portion at a center of a circle, a plurality of water dividing hole sets are circumferentially disposed between an outer circumference of the convex portion and an inner circumference of the divider at intervals, each of the plurality of water dividing hole sets comprises a plurality of water dividing holes in a radial direction, the outer circumference of the convex portion is an annular guiding inclined surface, water reaches the convex portion and is guided to flow to the plurality of water dividing hole sets by the guiding inclined surface, the water outlet cover is provided with a plurality of first water outlet holes and a plurality of second water outlet holes, the plurality of first water outlet holes are uniformly disposed on an outer circumference of the plurality of second water outlet holes, an axial center of the body is provided with a connecting member connected to the divider, an outer wall of the connecting member and an inner wall of the body are radially connected by a plurality of ribs, the plurality of ribs, the outer wall of the connecting member, and the inner wall of the body jointly define a plurality of chambers which are circumferentially disposed, one of two adjacent chambers of the plurality of chambers is a first water outlet chamber, the other one of the two adjacent chambers is a second water outlet chamber, a water outlet of the first water outlet chamber is disposed at a bottom of the first water outlet chamber which is close to the inner wall of the body, the bottom of the first water outlet chamber corresponding to the plurality of water dividing hole sets is provided with a first guiding surface, the first guiding surface inclines downwardly in a direction from the outer wall of the connecting member to the inner wall of the body, a lower end of the first guiding surface is connected to the water outlet of the first water outlet chamber, the water flows out from the plurality of water dividing hole sets, and then flows into the water outlet of the first water outlet chamber through the first guiding surface, the water outlet of the first water outlet chamber is disposed with a grid rectifier, a water outlet of the second water outlet chamber is disposed at a side wall of the second water outlet chamber corresponding to the outer wall of the connecting member, a bottom portion of the second water outlet chamber is disposed with a second guiding surface, the second guiding surface inclines downwardly in a direction from the inner wall of the body to the outer wall of the connecting member, a lower end of the second guiding surface is connected to the water outlet of the second water outlet chamber, the water flows out from the plurality of water dividing hole sets, and then flows into the water outlet of the second water outlet chamber through the second guiding surface, an enlarged port is disposed at a position of the body below the water outlet of the second water outlet chamber, the enlarged port has a gradually enlarged opening from one end adjacent to the second water outlet chamber to the other end, when the divider is connected to the connecting member, a gap is formed between a water outflow end of the plurality of water dividing hole sets and an upper surface of the plurality of ribs, and the first water outlet chamber and the second water outlet chamber are communicated by the gap, when the body is subjected to a rotational force along a circumferential direction, the body and the divider are relatively rotated so that all of the plurality of water dividing hole sets are located above the first water outlet chamber or the second water outlet chamber, when the plurality of water dividing hole sets are located above the first water outlet chamber, the water flows through the plurality of water dividing holes, flows through the first water outlet chamber, and then flows out from the first plurality of water outlet holes, when the plurality of water dividing hole sets are located above the second water outlet chamber, the water flows through the plurality of water dividing hole sets, flows through the second water outlet chamber, and then flows out from the plurality of second water outlet holes, and external air from the plurality of first water outlet holes enters into the first water outlet chamber through the water outlet of the first water outlet chamber, then enters into the water in the second water outlet chamber through the gap, and then flows out from the water outlet of the second water outlet chamber with the water in the second water outlet chamber, the water and the external air is mixed by a water-air mixing member to form the aerated water, and then the aerated water flows out from the plurality of second water outlet holes.

2. The jet regulator for switching water spray patterns according to claim 1, wherein the upper surface of the plurality of ribs is downwardly concaved in an arc shape in an axial direction.

3. The jet regulator for switching water spray patterns according to claim 1, wherein:

the connecting member is a socket hole, an inner side wall of the socket hole is circumferentially provided with a plurality of protruding strips at intervals, a groove is formed between two adjacent protruding strips of the plurality of protruding strips, and when the body is rotated relative to the divider so that one next groove or one next protruding strip is engaged with the divider along a rotation direction, the plurality of water dividing hole sets is correspondingly switched to a position located above the first water outlet chamber or the second water outlet chamber.

4. The jet regulator for switching water spray modes according to claim 1, wherein:

a water dividing piece and a metal grid are coaxially disposed to form the water-air mixing member, the water dividing piece is provided with a plurality of water dividing holes, the metal grid is provided with a plurality of meshes, and a hole size of the plurality of meshes is smaller than a hole size of the water dividing holes.

5. The jet regulator for switching water spray modes according to claim 4, wherein:

at a boundary between the plurality of first water outlet holes and the plurality of second water outlet holes, a side of the water outlet cover facing the body extends in a direction close to the body to form a first annular enclosure, and the water dividing piece and the metal grid are placed in an area surrounded by the first annular enclosure.

6. The jet regulator for switching water spray patterns according to claim 5, wherein:

the body extends in a radial direction to form a second annular enclosure at a lower end of the water outlet of the first water outlet chamber, an annular lock groove is disposed between an inner wall of the second annular enclosure and an outer wall of the enlarged port, and when the water outlet cover is mounted with the body, the first annular enclosure is embedded in the annular lock groove.

7. The jet regulator for switching water spray patterns according to claim 6, wherein:

a height of the second annular enclosure is less than a height of an outer wall of the body, and when the water outlet cover is mounted with the body, the water outlet cover is mainly located in the body.

8. The jet regulator for switching water spray patterns according to claim 7, wherein:

the plurality of first water outlet holes are uniformly disposed on an annular outer circumference of the water outlet cover, and the plurality of second water outlet holes are disposed in the first annular enclosure in a grid arrangement.

9. The jet regulator for switching water spray patterns according to claim 1, wherein:

a side of the divider away from the body is disposed with an accommodating chamber, the convex portion and the plurality of water dividing hole sets are disposed at a bottom of the accommodating chamber, a flow restrictor and the divider are coaxially disposed in the accommodating chamber, a front end of the flow restrictor is outwardly disposed with a position limiting block along an axial direction, and the position limiting block abuts against the convex portion, ensuring a certain distance between the flow restrictor and the plurality of water dividing hole sets.

10. The jet regulator for switching water spray patterns according to claim 1, wherein:

the grid rectifier comprises a first rib, which is circumferentially disposed, and three second ribs perpendicular to the first rib, the first rib and the second ribs jointly divide the water outlet of the first water outlet chamber into small water outlets, and the small water outlets are disposed in an array of 4×2.

11. The jet regulator for switching water spray patterns according to claim 1, further comprising:

an outer shell, wherein:

the outer shell is coated on the body by an interference fit, and when the outer shell is subjected to a rotational force in a circumferential direction, the outer shell and the body are rotated in a linked manner.

* * * * *